US005916262A

United States Patent [19]

Prosser et al.

[11] Patent Number: 5,916,262

[45] Date of Patent: Jun. 29, 1999

[54] CRYOGENIC RECTIFICATION SYSTEM FOR PRODUCING LOW PURITY OXYGEN AND HIGH PURITY OXYGEN

[75] Inventors: Neil Mark Prosser, Lockport; James Richard Handley, East Amherst; Ravindra Fulchand Pahade, Getzville; Brien Scott Wierzchowski, Tonawanda, all of N.Y.

[73] Assignee: Praxair Technology, Inc., Danbury, Conn.

[21] Appl. No.: 09/148,877

[22] Filed: Sep. 8, 1998

[51] Int. Cl.[6] ..... F25J 3/00

[52] U.S. Cl. ..... 62/646; 62/654

[58] Field of Search ..... 62/646, 654

[56] References Cited

U.S. PATENT DOCUMENTS

| | | | |
|---|---|---|---|
| 4,704,147 | 11/1987 | Kleinberg | 62/654 |
| 5,315,833 | 5/1994 | Ha et al. | 62/38 |
| 5,463,871 | 11/1995 | Cheung | 62/654 |
| 5,546,767 | 8/1996 | Dray et al. | 62/646 |
| 5,628,207 | 5/1997 | Howard et al. | 62/646 |
| 5,678,427 | 10/1997 | Bonaquist et al. | 62/650 |
| 5,682,766 | 11/1997 | Bonaquist et al. | 62/646 |

*Primary Examiner*—Ronald Capossela
*Attorney, Agent, or Firm*—Stanley Ktorides

[57] ABSTRACT

A cryogenic rectification system wherein low purity oxygen is recovered from a side column or the lower pressure column of a double column while a portion of the low purity oxygen is fed to an auxiliary column driven by fluid having a high nitrogen concentration wherein high purity oxygen is produced.

10 Claims, 4 Drawing Sheets

CRYOGENIC RECTIFICATION SYSTEM FOR PRODUCING LOW PURITY OXYGEN AND HIGH PURITY OXYGEN

TECHNICAL FIELD

This invention relates generally to the cryogenic rectification of feed air and, more particularly, to the cryogenic rectification of feed air to produce low purity oxygen and high purity oxygen.

BACKGROUND ART

The demand for low purity oxygen is increasing in applications such as glassmaking, steelmaking and energy production. Low purity oxygen is generally produced in large quantities by the cryogenic rectification of feed air.

Some users of low purity oxygen, for example integrated steel mills, often require some high purity oxygen in addition to low purity gaseous oxygen. While it has long been possible to produce some high purity oxygen along with low purity oxygen, conventional systems cannot effectively produce significant quantities of high purity oxygen along with low purity oxygen without a significant redesign of the column system.

Accordingly it is an object of this invention to provide a cryogenic rectification system which can more effectively produce both low purity oxygen and high purity oxygen with high recovery.

SUMMARY OF THE INVENTION

The above and other objects, which will become apparent to one skilled in the art upon a reading of this disclosure, are attained by the present invention, one aspect of which is:

A method for producing low purity oxygen and high purity oxygen comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing low purity oxygen by cryogenic rectification within the lower pressure column;

(C) recovering a first portion of the low purity oxygen from the lower pressure column as product low purity oxygen;

(D) passing a second portion of the low purity oxygen from the lower pressure column as a liquid into the upper portion of an auxiliary column and down the auxiliary column against upflowing vapor to produce high purity oxygen liquid;

(E) at least partially vaporizing high purity oxygen liquid to produce high purity oxygen fluid; and (F) recovering at least some of the high purity oxygen fluid as product high purity oxygen.

Another aspect of the invention is:

Apparatus for producing low purity oxygen and high purity oxygen comprising:

(A) a higher pressure column and means for passing feed air into the higher pressure column;

(B) a lower pressure column and means for passing fluid from the higher pressure column into the lower pressure column;

(C) means for recovering low purity oxygen from the lower portion of the lower pressure column;

(D) an auxiliary column and means for passing low purity oxygen from the lower portion of the lower pressure column into the upper portion of the auxiliary column;

(E) a reboiler for generating upflowing vapor for the auxiliary column; and (F) means for recovering high purity oxygen from the lower portion of the auxiliary column.

A further aspect of the invention is:

A method for producing low purity oxygen and high purity oxygen comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing further enriched oxygen by cryogenic rectification within the lower pressure column;

(C) passing further enriched oxygen from the lower pressure column into the upper portion of a side column and producing low purity oxygen by cryogenic rectification within the side column;

(D) recovering a first portion of the low purity oxygen from the side column as product low purity oxygen;

(E) passing a second portion of the low purity oxygen from the side column as a liquid into the upper portion of an auxiliary column and down the auxiliary column against upflowing vapor to produce high purity oxygen liquid;

(F) at least partially vaporizing high purity oxygen liquid to produce high purity oxygen fluid; and (G) recovering at least some of the high purity oxygen fluid as product high purity oxygen.

Yet another aspect of the invention is:

Apparatus for producing low purity oxygen and high purity oxygen comprising:

(A) a higher pressure column and means for passing feed air into the higher pressure column;

(B) a lower pressure column and means for passing fluid from the higher pressure column into the lower pressure column;

(C) a side column and means for passing fluid from the lower pressure column into the side column;

(D) means for recovering low purity oxygen from the lower portion of the side column;

(E) an auxiliary column and means for passing low purity oxygen from the lower portion of the side column into the upper portion of the auxiliary column;

(F) a reboiler for generating upflowing vapor for the auxiliary column; and (G) means for recovering high purity oxygen from the lower portion of the auxiliary column.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "reboiler" means a heat exchange device that generates column upflow vapor from column liquid. A reboiler may be located within or outside of the column.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "low purity oxygen" means a fluid having an oxygen concentration within the range of from 70 to 98 mole percent.

As used herein, the term "high purity oxygen" means a fluid having an oxygen concentration greater than 98 mole percent.

Figure 1:
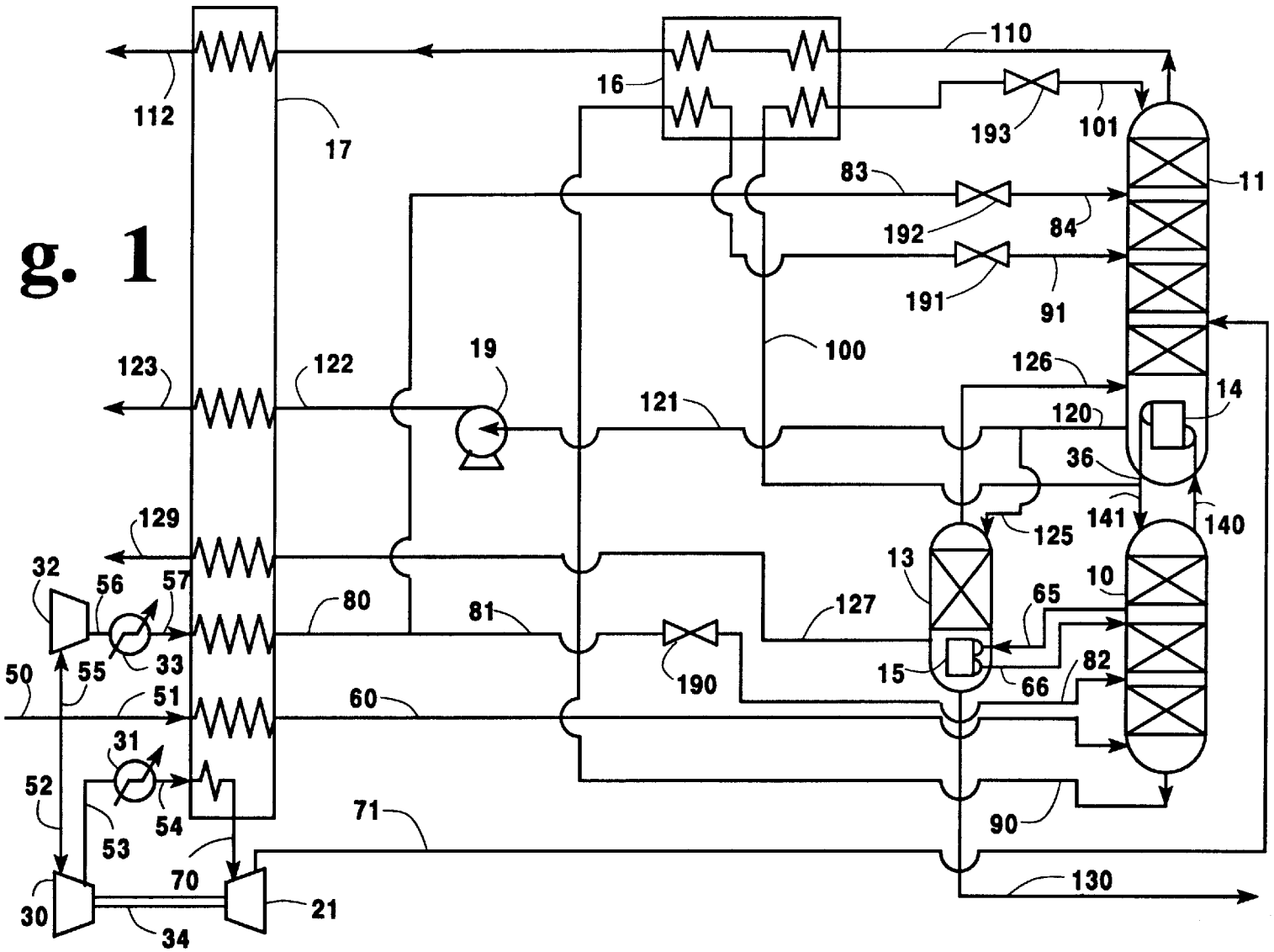
FIG. 1 is a schematic representation of one preferred embodiment of the invention wherein the auxiliary column reboiler is driven by nitrogen-containing fluid from the higher pressure column.

The numerals in the Drawings are the same for the common elements.

DETAILED DESCRIPTION

The invention enables the recovery of low purity oxygen from a side column or the lower pressure column of a double column system while employing an auxiliary column for the production and recovery of high purity oxygen. The invention serves to minimize design alterations thus improving the efficacy of the production of the dual purity oxygen product. The invention will be described in greater detail with reference to the Drawings.

Referring now to FIG. 1, feed air 50, which has been cleaned of high boiling impurities such as water vapor, carbon dioxide and hydrocarbons, and is at a pressure generally within the range of from 50 to 100 pounds per square inch absolute (psia), is divided into three portions designated 51, 52 and 55. About 3 to 20 percent of feed air 50 is passed in stream 52 to compressor 30 wherein it is compressed to a pressure generally within the range of from 70 to 200 psia. Resulting compressed feed air portion 53 is cooled of the heat of compression by passage through cooler 31 and resulting stream 54 is further cooled by partial traverse of main heat exchanger 17 by indirect heat exchange with return streams. Resulting feed air stream 70 is then turboexpanded by passage through turboexpander 21 to generate refrigeration and resulting turboexpanded feed air stream 71 is passed into lower pressure column 11. The operation of turboexpander 21 serves to drive compressor 30 through shaft 34.

About 24 to 35 percent of feed air 50 is passed in stream 55 to compressor 32 wherein it is compressed to a pressure generally within the range of from 60 to 800 psia. Resulting compressed feed air portion 56 is cooled of the heat of compression by passage through cooler 33 and resulting stream 57 is cooled by passage through main heat exchanger 17 by indirect heat exchange with return streams. Preferably stream 57 is partially condensed, most preferably totally condensed, by passage through main heat exchanger 17. Resulting feed air stream 80 is divided into streams 83 and 81. Stream 81 is passed through valve 190 and as stream 82 into higher pressure column 10. Stream 83 is passed through valve 194 and as stream 84 into lower pressure column 11. If desired stream 83 may be subcooled, such as by passage through heat exchanger 16, prior to being passed into lower pressure column 11. The remaining portion of feed air 50 is passed as stream 51 through main heat exchanger 17 wherein it is cooled by indirect heat exchange with return streams and resulting cooled feed air stream 60 is passed into higher pressure column 10.

First or higher pressure column 10 is operating at a pressure generally within the range of from 44 to 95 psia. Within higher pressure column 10 the feed air is separated by cryogenic rectification into nitrogen-enriched vapor and oxygen-enriched liquid. Oxygen-enriched liquid is withdrawn from the lower portion of column 10 in stream 90, subcooled by passage through heat exchanger 16, passed through valve 191 and, as stream 91, passed into lower pressure column 11. Nitrogen-enriched vapor is withdrawn from the upper portion of column 10 in stream 140 and passed into reboiler 14 wherein it is condensed by indirect heat exchange with low purity oxygen. Resulting nitrogen-enriched liquid 36 is divided into stream 141, which is returned to higher pressure column 10 as reflux, and into stream 100, which is subcooled by passage through heat exchanger 16, passed through valve 193 and, as stream 101, passed into lower pressure column 11 as reflux.

Second or lower pressure column 11 is operating at a pressure less than that of higher pressure column 10 and generally within the range of from 16 to 25 psia. Within lower pressure column 11 the various feeds are separated by cryogenic rectification into nitrogen-rich fluid and low purity oxygen. Nitrogen-rich fluid is withdrawn from the upper portion of column 11 as vapor stream 110, warmed by passage through heat exchangers 16 and 17, and removed from the system in stream 112 which may be recovered in whole or in part as product nitrogen. Low purity oxygen is recovered from the lower portion of lower pressure column 11. In the embodiment of the invention illustrated in FIG. 1, low purity oxygen is withdrawn from column 11 as liquid stream 120 and passed as stream 121 to liquid pump 19 wherein it is increased in pressure. Liquid pressure head may be used in some cases to increase the pressure of the low purity oxygen. Pressurized low purity oxygen stream 122 is vaporized by passage through main heat exchanger 17 and then recovered in stream 123 as product low purity oxygen at a pressure generally within the range of from 25 to 450 psia.

A second portion of the low purity oxygen is passed from the lower pressure column into the upper portion of an auxiliary column. In the embodiment of the invention illustrated in FIG. 1, low purity oxygen liquid is withdrawn from column 11 in stream 120, a first portion 121 of stream 120 is processed as described above, and a second portion 125 of stream 120 is passed into the upper portion of auxiliary column 13. Alternatively, first portion 121 and second portion 125 could be withdrawn separately from lower pressure column 11. Low purity oxygen liquid flows down auxiliary column 13 against upflowing vapor and in the process nitrogen and argon within the downflowing liquid are stripped out of the downflowing liquid into the upflowing vapor resulting in the production of high purity oxygen liquid at the bottom of auxiliary column 13, and remaining vapor in the upper portion of auxiliary column 13. The remaining vapor is withdrawn from the upper portion of auxiliary column and passed in stream 126 into lower pressure column 11.

High purity oxygen liquid from the bottom of auxiliary column 13 is at least partially vaporized in reboiler 15 to produce high purity oxygen vapor and, if not totally vaporized, remaining high purity oxygen liquid. In the embodiment of the invention illustrated in FIG. 1, the vaporization of the high purity oxygen liquid, which in this embodiment is a partial vaporization, is effected by indirect heat exchange with nitrogen-containing fluid from an intermediate level of the higher pressure column. Referring back to FIG. 1, vapor having a nitrogen concentration generally within the range of from 90 to 99.5 mole percent is withdrawn from higher pressure column 10 at a level generally within the range of from 1 to 20 equilibrium stages below the top of column 10 in stream 65 and passed into reboiler 15 wherein it is at least partially condensed by the aforesaid indirect heat exchange with the high purity oxygen. The resulting fluid is then passed from reboiler 15 in stream 66 back to higher pressure column 10, preferably at or slightly above the same tray or equilibrium stage from which stream 65 is taken.

At least a portion of the high purity oxygen vapor is passed up auxiliary column 13 as the aforesaid upflowing vapor. At least some of at least one of the high purity oxygen vapor and high purity oxygen liquid is recovered as product high purity oxygen. The embodiment of the invention illustrated in FIG. 1 illustrates the recovery of both high purity oxygen vapor and high purity oxygen liquid. In this embodiment a portion of the high purity oxygen vapor is withdrawn from the lower portion of auxiliary column 13 in stream 127, warmed by passage through main heat exchanger 17 and recovered as high purity oxygen product in stream 129. High purity oxygen liquid is withdrawn from the lower portion of auxiliary column 13 in stream 130 and recovered a high purity oxygen product. In a variation not illustrated in FIG. 1, high purity oxygen may be withdrawn from the auxiliary column as liquid, raised to a higher pressure, vaporized and the recovered as elevated pressure high purity oxygen product vapor.

Figure 2:
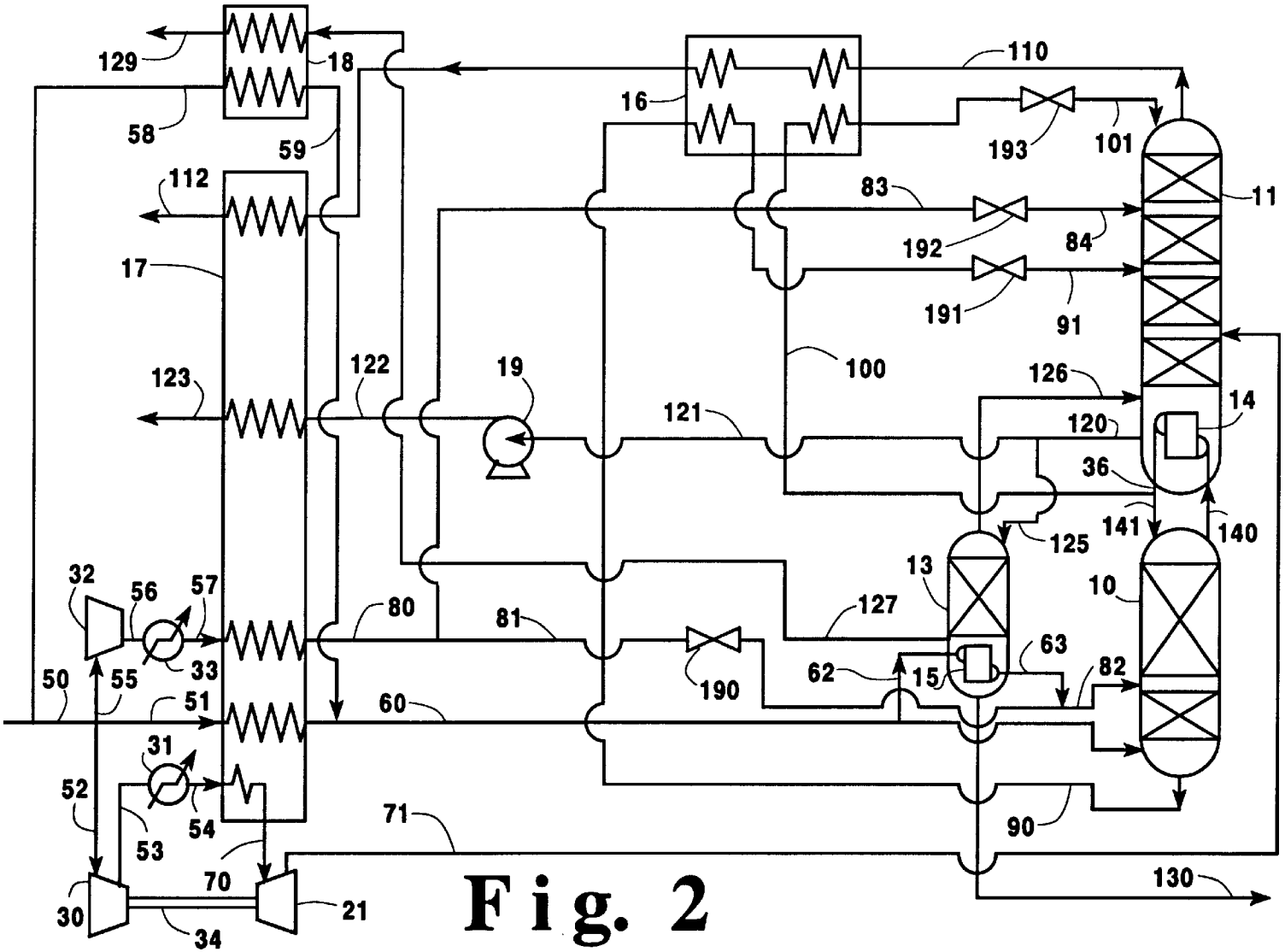
FIG. 2 is a schematic representation of another preferred embodiment of the invention wherein the auxiliary column reboiler is driven by feed air.

FIG. 2 illustrates another embodiment of the invention wherein reboiler 15 is driven by a portion of the feed air. This embodiment is particularly advantageous when the oxygen concentration of the low purity oxygen product is about 90 mole percent or less. The elements of the embodiment illustrated in FIG. 2 which are common with those illustrated in FIG. 1 will not be described again in detail.

Referring now to FIG. 2 another portion 58 of feed air 50 is cooled by passage through supplemental heat exchanger 18 and resulting cooled stream 59 is passed into feed air stream 60. A portion 62 of feed air stream 60 is passed into reboiler 15 wherein it is at least partially condensed by indirect heat exchange with the at least partially vaporizing high purity oxygen liquid. Resulting feed air stream 63 from reboiler 15 is passed into stream 82 and into higher pressure column 10. High purity oxygen vapor 127 is warmed by passage through heat exchanger 18 prior to recovery in stream 129. By using a portion of the feed air to drive reboiler 15 no changes are required in the design of the higher pressure column. The use of the supplemental heat exchanger to warm the high purity oxygen vapor enables the design of the main heat exchanger to remain unchanged from its design for a system which produces only low purity oxygen.

Figure 3:
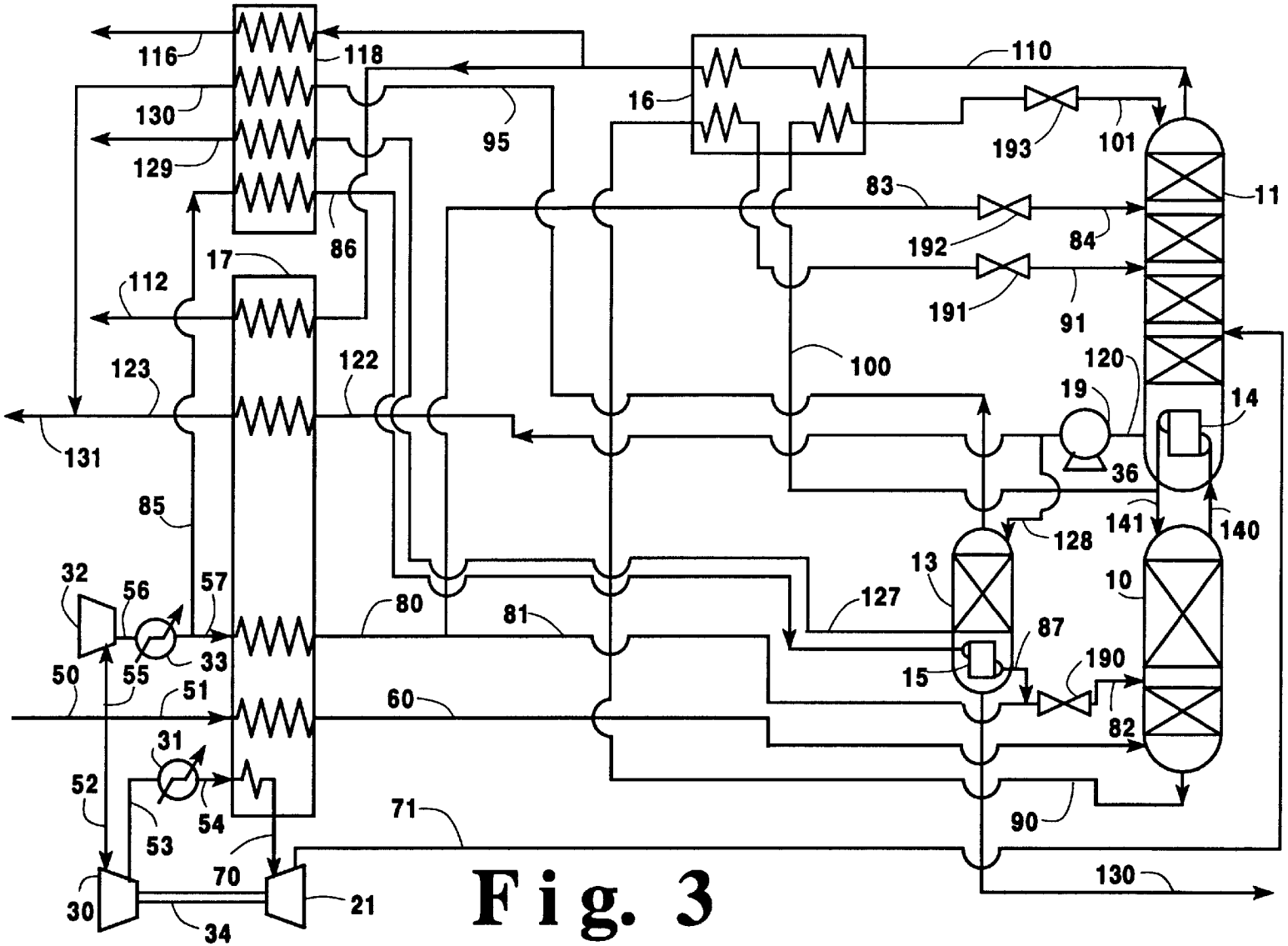
FIG. 3 is a schematic representation of another preferred embodiment of the invention wherein the feed to the auxiliary column is pressurized prior to introduction into the column.

FIG. 3 illustrates another embodiment of the invention wherein reboiler 15 is driven by a portion of the feed air and the low purity oxygen feed to the auxiliary column is pressurized prior to introduction. As before the elements common with the previously described embodiments will not be discussed again in detail.

Referring now to FIG. 3, a portion 85 of feed air stream 57 is cooled by passage through supplemental heat exchanger 118 and resulting cooled stream 86 is passed into reboiler 15 wherein it is at least partially condensed by indirect heat exchange with the at least partially vaporizing high purity oxygen liquid. Resulting feed air stream 87 from reboiler 15 is passed into stream 81 and then into higher pressure column 10 as part of stream 82. All of low purity oxygen stream 120 is pressurized in liquid pump 19 and the portion of stream 120 which is passed into auxiliary column 13 is taken downstream of pump 19 as illustrated by stream 128. Remaining vapor withdrawn from the upper portion of auxiliary column 13 is not passed into column 11. Rather, as shown by stream 95, remaining vapor is passed through heat exchanger 118 and may be recovered as additional low purity oxygen. In the embodiment illustrated in FIG. 3, stream 95 is warmed by passage through heat exchanger 118 and resulting stream 130 is combined with stream 123 to form stream 131 for recovery. In addition a portion 115 of stream 110 is warmed by passage through heat exchanger 118 and removed from the system in stream 116.

Figure 4:
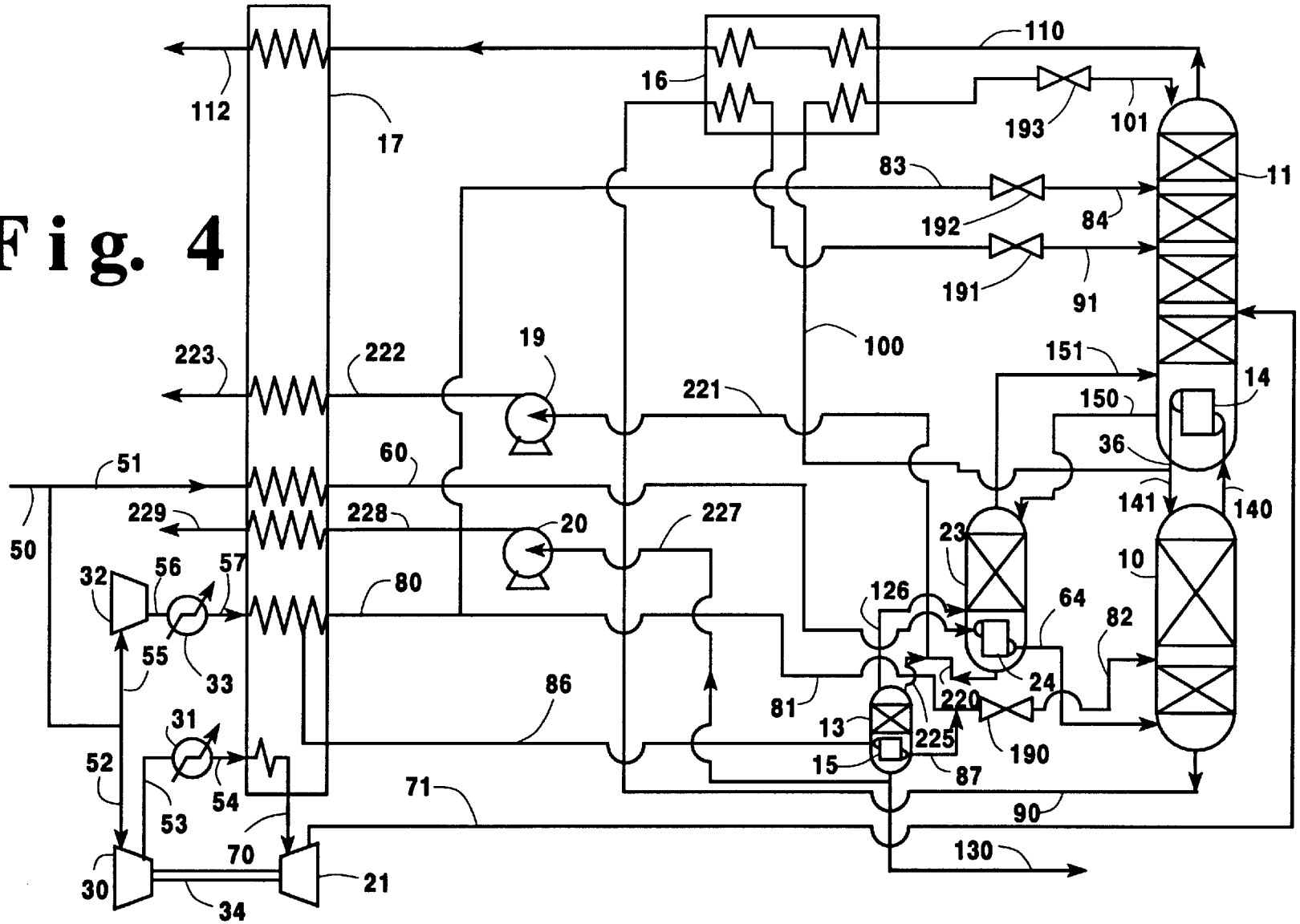
FIG. 4 is a schematic representation of yet another preferred embodiment of the invention wherein a side column is employed between the lower pressure column and the auxiliary column for the production of low purity oxygen.

FIG. 4 illustrates another embodiment of the invention wherein a side column is interposed between the lower pressure column and the auxiliary column for the production of low purity oxygen. In the embodiment illustrated in FIG. 4 the fluids passed into lower pressure column 11 are separated by cryogenic rectification into nitrogen-rich vapor and further enriched oxygen. The further enriched oxygen is passed in stream 150 from lower pressure column 11 into side column 23 and down side column 23 against upflowing vapor. In the process low purity oxygen is produced by cryogenic rectification and is collected in the lower portion of side column 23. Low purity oxygen is withdrawn from side column 23 in stream 220. A portion is passed in stream 221 to liquid pump 19 wherein it is raised in pressure. Pressurized stream 222 is vaporized by passage through main heat exchanger 17 and recovered as product low purity oxygen in stream 223.

Another portion 225 of stream 220 is passed into the upper portion of auxiliary column 13 and is processed as previously described in conjunction with the embodiments illustrated in FIGS. 1–3. In the embodiment illustrated in FIG. 4, a portion 227 of high purity oxygen liquid stream 130 is passed to liquid pump 20 wherein it is raised in pressure. Resulting pressurized high purity oxygen stream 128 is vaporized by passage through main heat exchanger 17 and recovered as high pressure high purity oxygen gas in stream 229.

In the embodiment of the invention illustrated in FIG. 4, auxiliary column 13 is driven by a portion 86 of feed air stream 80 which is condensed in reboiler 15. Resulting feed air stream 87 is then passed into stream 81 and then into higher pressure column 10. Vapor stream 126 is not passed into lower pressure column 11 but rather is passed into side column 23 wherein it forms part of the upflowing vapor. Another part of the upflowing vapor for side column 23 is formed by the reboil of that column. Feed air stream 60 is not passed directly into column 10. Rather, stream 60 is passed into bottom reboiler 24 of side column 23 wherein it serves to reboil the low purity oxygen bottom liquid of side column 23. Resulting feed air stream 64 is then passed into higher pressure column 10. The upflowing vapor in side column 23 is withdrawn from the upper portion of side column 23 and passed as stream 151 into lower pressure column 11.

Although the invention has been described in detail with reference to certain preferred embodiments, those skilled in the art will recognize that there are other embodiments of the invention within the spirit and the scope of the claims.

We claim:

1. A method for producing low purity oxygen and high purity oxygen comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing low purity oxygen by cryogenic rectification within the lower pressure column;

(C) recovering a first portion of the low purity oxygen from the lower pressure column as product low purity oxygen;

(D) passing a second portion of the low purity oxygen from the lower pressure column as a liquid into the upper portion of an auxiliary column and down the auxiliary column against upflowing vapor to produce high purity oxygen liquid;

(E) at least partially vaporizing high purity oxygen liquid to produce high purity oxygen fluid; and (F) recovering at least some of the high purity oxygen fluid as product high purity oxygen.

2. The method of claim 1 wherein the high purity oxygen liquid is at least partially vaporized by indirect heat exchange with fluid taken from an intermediate level of the higher pressure column.

3. The method of claim 1 wherein the high purity oxygen liquid is at least partially vaporized by indirect heat exchange with a portion of the feed air prior to passing that portion into the higher pressure column.

4. The method of claim 1 further comprising increasing the pressure of the second portion of the low purity oxygen taken from the lower pressure column prior to passing it into the auxiliary column.

5. Apparatus for producing low purity oxygen and high purity oxygen comprising:

(A) a higher pressure column and means for passing feed air into the higher pressure column;

(B) a lower pressure column and means for passing fluid from the higher pressure column into the lower pressure column;

(C) means for recovering low purity oxygen from the lower portion of the lower pressure column;

(D) an auxiliary column and means for passing low purity oxygen from the lower portion of the lower pressure column into the upper portion of the auxiliary column;

(E) a reboiler for generating upflowing vapor for the auxiliary column; and (F) means for recovering high purity oxygen from the lower portion of the auxiliary column.

6. The apparatus of claim 5 further comprising means for passing fluid from an intermediate level of the higher pressure column to the reboiler, and means for passing fluid from the reboiler to an intermediate level of the higher pressure column.

7. The apparatus of claim 5 wherein the means for passing feed into the higher pressure column includes the reboiler.

8. The apparatus of claim 5 wherein the means for passing low purity oxygen from the lower portion of the lower pressure column into the upper portion of the auxiliary column includes a liquid pump.

9. A method for producing low purity oxygen and high purity oxygen comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing further enriched oxygen by cryogenic rectification within the lower pressure column;

(C) passing further enriched oxygen from the lower pressure column into the upper portion of a side column and producing low purity oxygen by cryogenic rectification within the side column;

(D) recovering a first portion of the low purity oxygen from the side column as product low purity oxygen;

(E) passing a second portion of the low purity oxygen from the side column as a liquid into the upper portion of an auxiliary column and down the auxiliary column against upflowing vapor to produce high purity oxygen liquid;

(F) at least partially vaporizing high purity oxygen liquid to produce high purity oxygen fluid; and (G) recovering at least some of the high purity oxygen fluid as product high purity oxygen.

10. Apparatus for producing low purity oxygen and high purity oxygen comprising:

(A) a higher pressure column and means for passing feed air into the higher pressure column;

(B) a lower pressure column and means for passing fluid from the higher pressure column into the lower pressure column;

(C) a side column and means for passing fluid from the lower pressure column into the side column;

(D) means for recovering low purity oxygen from the lower portion of the side column;

(E) an auxiliary column and means for passing low purity oxygen from the lower portion of the side column into the upper portion of the auxiliary column;

(F) a reboiler for generating upflowing vapor for the auxiliary column; and (G) means for recovering high purity oxygen from the lower portion of the auxiliary column.

* * * * *